US010870513B2

(12) United States Patent
Gonitianer et al.

(10) Patent No.: US 10,870,513 B2
(45) Date of Patent: Dec. 22, 2020

(54) STACKABLE SYSTEM CONTAINER

(71) Applicant: BS Systems GmbH & Co. KG, Zusmarshausen (DE)

(72) Inventors: Reiner Gonitianer, Dillingen (DE); Jan Kögel, Zusmarshausen (DE)

(73) Assignee: BS Systems GmbH & Co. KG, Zusmarshausen (DE)

( * ) Notice: Subject to any disclaimer, the term of this patent is extended or adjusted under 35 U.S.C. 154(b) by 0 days.

(21) Appl. No.: 16/317,188

(22) PCT Filed: Apr. 11, 2017

(86) PCT No.: PCT/EP2017/058667

§ 371 (c)(1),
(2) Date: Jan. 11, 2019

(87) PCT Pub. No.: WO2018/010857

PCT Pub. Date: Jan. 18, 2018

(65) Prior Publication Data

US 2019/0291922 A1 Sep. 26, 2019

(30) Foreign Application Priority Data

Jul. 13, 2016 (DE) ..... 10 2016 112 854

(51) Int. Cl.
*B65D 21/032* (2006.01)
*B65D 21/02* (2006.01)
*B25H 3/02* (2006.01)

(52) U.S. Cl.
CPC ..... *B65D 21/0228* (2013.01); *B25H 3/02* (2013.01); *B65D 21/0217* (2013.01); *B65D 21/0223* (2013.01)

(58) Field of Classification Search
CPC ..... B65D 21/0228; B65D 21/0209; B65D 21/0217; B65D 21/0223; B25H 3/02
See application file for complete search history.

(56) References Cited

U.S. PATENT DOCUMENTS 5,101,969 A 4/1992 Umiker
6,082,539 A 7/2000 Lee
(Continued)

FOREIGN PATENT DOCUMENTS

DE 4009960 A1 10/1990
DE 9314298 U1 2/1994
(Continued)

OTHER PUBLICATIONS

International Search Report and Written Opinion for PCT/EP2017/058672 filed Apr. 11, 2017.
(Continued)

*Primary Examiner* — Stephen J Castellano
(74) *Attorney, Agent, or Firm* — Paul D. Bianco; Stephen Bongini; Fleit Intellectual Property Law

(57) ABSTRACT

A stackable system container includes a bottom part and a lid part fastened to the bottom part. Respective coupling devices are movably fastened to two opposite side walls of the bottom part. In order to enable dimensionally stable and connected stacking of structurally identical system containers and also modular stacking of different system containers, each coupling device can be moved between an idle position, in which the coupling device is arranged below a top side of the lid part, and a coupling position, in which the coupling device projects beyond the top side of the lid part.

18 Claims, 6 Drawing Sheets

(56) References Cited

U.S. PATENT DOCUMENTS

| | | | | |
|---|---|---|---|---|
| 6,874,634 | B2 * | 4/2005 | Riley | A61L 2/26 206/370 |
| 8,590,704 | B2 | 11/2013 | Koenig et al. | |
| 9,131,770 | B2 | 9/2015 | Stegherr | |
| 2003/0094392 | A1 | 5/2003 | Meier et al. | |
| 2011/0139666 | A1 | 6/2011 | Sosnovsky et al. | |
| 2014/0062281 | A1 | 3/2014 | Stegherr | |
| 2016/0008972 | A1 | 1/2016 | Chen | |
| 2016/0144500 | A1 | 5/2016 | Chen | |
| 2016/0213115 | A1 | 7/2016 | Gonitianer et al. | |
| 2019/0308772 | A1 | 10/2019 | Gonitianer | |
| 2019/0315515 | A1 | 10/2019 | Gonitianer | |

FOREIGN PATENT DOCUMENTS

| | | | |
|---|---|---|---|
| DE | 29723812 | U1 | 4/1999 |
| DE | 10 2007 032382 | A1 | 1/2008 |
| DE | 10 2011 110207 | A1 | 2/2013 |
| DE | 20 2013 003741 | U1 | 4/2013 |
| DE | 202014101556 | U1 | 7/2014 |
| DE | 20 2014 103695 | U1 | 10/2014 |
| DE | 10 2013 110496 | A1 | 3/2015 |
| EP | 0555533 | A1 | 8/1993 |
| EP | 0997234 | A1 | 5/2000 |
| EP | 1238602 | A2 | 9/2002 |
| EP | 1516703 | A1 | 3/2005 |
| EP | 2020188 | A1 | 2/2009 |
| EP | 2703310 | A1 | 3/2014 |
| WO | 2011/000387 | A1 | 1/2011 |
| WO | 2018/10858 | A1 | 1/2018 |
| WO | 2018/10859 | A1 | 1/2018 |

OTHER PUBLICATIONS

Result of Examination Report for DE 10 2016 112 853.8, filed Jul. 13, 2016.

International Search Report and Written Opinion for PCT/EP2017/058667 filed Apr. 11, 2017.

Result of Examination Report for DE 10 2016 112 854.6, filed Jul. 13, 2016.

International Search Report and Written Opinion for PCT/EP2017/058668 filed Apr. 11, 2017.

Result of Examination Report for DE 10 2016 112 855.4, filed Jul. 13, 2016.

English translation of International Preliminary Examination Report for PCTEP17/058667, filed Apr. 11, 2017.

English translation of International Preliminary Examination Report for PCT/EP17/058668, filed Apr. 11, 2017.

International Preliminary Examination Report with English translation of Written Opinion for PCT/EP17/058672, filed Apr. 11, 2017.

Office Action dated Apr. 16, 2020, for U.S. Appl. No. 16/317,175.

Restriction Requirement Office Action dated May 19, 2020 for U.S. Appl. No. 16/317,234.

* cited by examiner

STACKABLE SYSTEM CONTAINER

This application is the national stage (Rule 371) of international application No. PCT/EP2017/058667 filed Apr. 11, 2017.

FIELD OF THE INVENTION

The invention concerns a stackable system container.

BACKGROUND OF THE INVENTION

A stackable system container having a bottom part with a storage space open on the top and a lid that limits the storage space on the top and is fastened pivotably to the bottom part is known from DE 10 2013 110 496. The system container also has two coupling devices movably fastened on opposite side walls of the bottom part that serve for coupling the system container with additional system containers and therefore permit secure stacking of such system containers. The coupling devices are designed to cooperate retentively with corresponding coupling elements of an equivalent system container arranged underneath, protruding upward above the top of the system container and the lid. The snap-in tabs are an integral component of the corresponding bottom part, and each includes at least one latch for engagement of the coupling device. The coupling elements are also arranged on opposite ends of the top of the system container and permit centering and positioning of several such system containers one atop the other. After alignment of several system containers, they can be connected stably but releasably via the coupling devices and coupling elements. This shape-mated and force-fit joining permits the comfortable carrying in one hand of several system containers connected to one another. However, a shortcoming here is that a specific fastening system is established by the coupling elements, and the system container system is therefore less modular when several different system containers are stacked. The coupling elements also protrude beyond the top of the lid so that the top of the cover can be used only with considerable restriction as a storage space.

SUMMARY OF THE INVENTION

One aspect of the disclosure therefore relates to a stackable system container that permits both shape-stable and connected stacking of identical system containers and also modular stacking of different system containers. The shape-stable connection of the stackable system containers should also be deactivatable so that the system containers can be detached from one another.

Advantageous embodiments of the invention are also disclosed.

The stackable system container according to the invention is characterized by the fact that each coupling device is movable between a rest position in which the coupling device is arranged beneath the top of the lid and a coupling position in which the coupling device protrudes above the top of the lid. Depending on the application, the coupling devices can be pivoted on this account between a pivoted-out protruding position and a pivoted-in retracted position. The coupling devices in the protruding coupling position can cooperate retentively with an identical system container arranged atop it, whereas in the pivoted-in rest position the coupling devices do not inhibit the stacking of system containers having a different design on the system container, and automatic coupling between identical system containers is also prevented. The top of the system container and the lid can also be used without problem as a storage or work space.

Identical or equivalent system containers are understood to mean system containers that are laid out to cooperate retentively with the two coupling devices of the system container, in which case different variants are included with reference to dimensions or the presence of additional elements.

In a preferred embodiment, each coupling device can have at least one coupling element for positioning and fixing of an additional system container on the top of the lid. The coupling element can be an undercut, a protrusion, or a recess that permits shape-mated connection with an additional system container.

With particular preference, a counter-element, which corresponds to the coupling element and is designed for retentive cooperation with an equivalent coupling element of the coupling device of an additional system container arranged underneath, is provided on the opposite side walls beneath each coupling device. Particularly stable shape-mated connection between two such system containers, which are stacked equally aligned one atop the other, can be achieved on this account.

In an advantageous embodiment, the coupling devices are fastened to the side walls to pivot between the pivoted-in rest position and the pivoted-out coupling position. This permits particularly simple operation of the coupling devices.

In order to fix the coupling devices, specifically in the pivoted-out coupling position, a locking element can be movably fastened to each coupling device and/or the bottom part. A spring element with particular advantage can then also be arranged on each coupling device and/or the bottom part, which forces the locking element into a locking position in which the locking element locks the corresponding coupling device in the coupling position.

A snap-in tab can be provided on the opposite side walls of the bottom part, which can be snapped into the locking position using the corresponding locking element. Each coupling device can thus be locked in shape-mated fashion using the corresponding locking element releasably in the pivoted-out coupling position.

In a particularly stable and space-saving embodiment, each coupling device can be fastened to pivot around a pivot axis parallel to the side walls, and the pivot axis is arranged so that the locking element in the pivoted-in rest position of the coupling device is arranged beneath the pivot axis and in the pivoted-out coupling position above the pivot axis.

With particular preference, each coupling device can be pivoted between the pivoted-in rest position and the pivoted-out coupling position by 160-200°, but essentially by 180°.

In order to arrange the coupling devices in the rest position in space-saving fashion and also to protect them from damage, the opposite side walls can each have a recess into which the coupling devices can be moved in the rest position.

In order to guarantee locking of the coupling devices in the rest position, at least one snap-in device can be provided on each coupling device.

For proper positioning of the coupling devices, specifically in the pivoted-in rest position, at least one snap-in device can be provided on each coupling device to snap the corresponding coupling device into the pivoted-in rest position and/or the pivoted-in position. Each snap-in device can then preferably be overcome by exerting a sufficient torque on the corresponding coupling element, which can be achieved, for example, using a spring-biased locking ball in a corresponding locking groove or a locking protrusion, which is moved over a locking ridge. However, a release lever can also be provided, through which the snap-in device can be overcome.

In another preferred embodiment, the coupling devices can have locking means for the lid that lock the lid in the upward protruding coupling position to prevent opening. Unintended opening of a stacked system container is reliably prevented on this account. For example, a laterally protruding retaining connector can be provided on the lid, which is retentively enclosed by the coupling device in the coupling position so that the coupling device firmly connects the bottom part to the lid such that the lid cannot be inadvertently opened. The coupling device can also have a locking element that is movably fastened to the coupling device and in a locking position cooperates in shape-mated and/or force-fit fashion with the retaining connector in the coupling position of the coupling device so that the coupling device is locked relative to the retaining connector. Only after activation of the locking element in a release position can the coupling element be moved into the rest position so that the lid can be pivoted relative to the bottom part.

BRIEF DESCRIPTION OF THE DRAWINGS

Additional details and preferences of the invention are apparent from the following description of preferred practical examples with reference to the drawings. In the drawings.

DETAILED DESCRIPTION OF THE INVENTION

Figure 1:
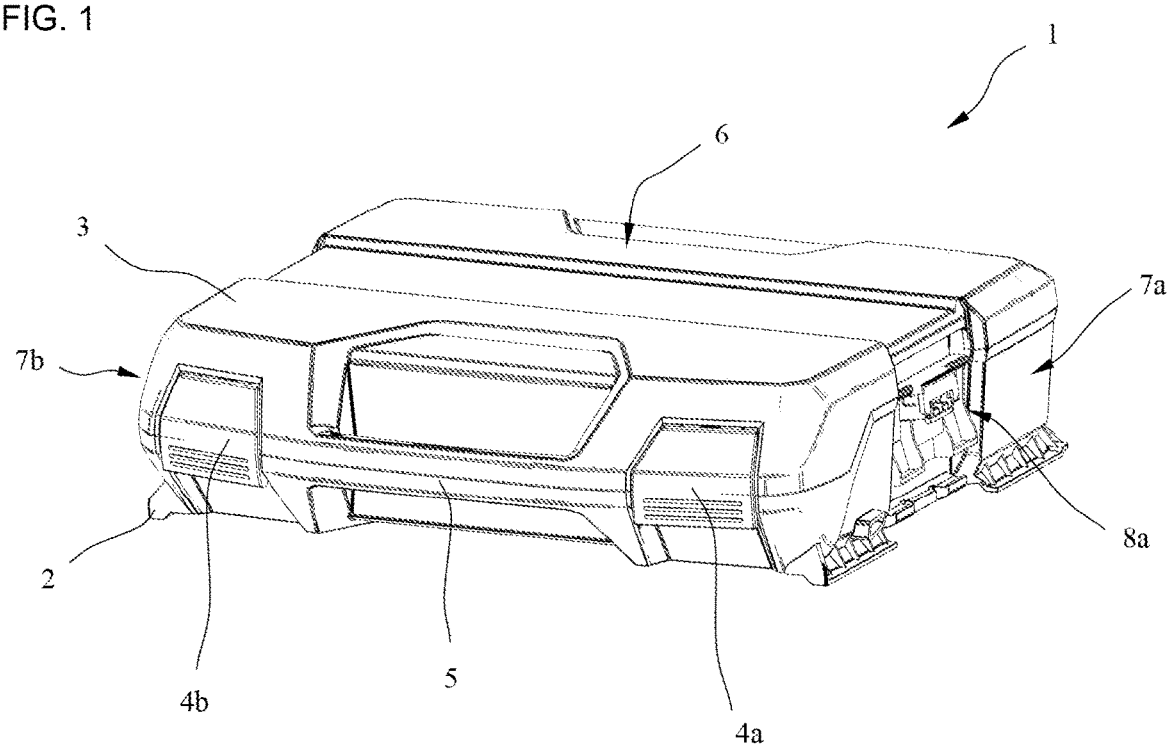
FIG. 1 shows a perspective view of a stackable system container with laterally arranged coupling devices pivoted downward into the rest position.

A perspective view of a stackable system container 1 is shown in FIG. 1. The system container 1 includes a lower bottom part 2 and an upper lid 3 fastened to pivot on the bottom part 2. The lid 3, however, could also be designed separately from the bottom part 2. The bottom part 2 has an upward-facing storage space (not shown), which is bounded on top by the lid 3. The lid 3 is connected to pivot with the bottom part 2 via a swivel joint arranged on the rear edge of the lid 3. In order to fasten the lid 3 releasably to the bottom part 2 and thus reliably close the enclosed storage space, two closure devices 4*a*, 4*b* are provided on the front side of the system container 1 that are articulated on the lid 3 and cooperate in locking fashion with the bottom part 2 in the depicted closed position of the lid 3.

The system container 1 can be used, for example, for transport and storage of tools and working materials for craftsmen. For this purpose, the bottom part 2 preferably has a bottom section and four side walls that delimit a storage space open only on top. However, it is also possible to design the bottom part like the container disclosed in EP 2 703 310. In this respect, reference is made to EP 2 703 310, whose contents are hereby included in this application.

For simple transport of the system container 1, a handle 5 is arranged on the front side of the system container 1 that is formed both by the bottom part 2 and by the lid 3. In a further embodiment (not shown), an additional retaining bracket can also be fastened on the top 6 of the lid 3 to pivot between an upward protruding position and a pivoted-in position. This additional retaining bracket in the pivoted-in position can be countersunk in a handle recess of the lid 3 so that the additional retaining bracket forms a stepless flat top 6 of the system container 1 with the lid 3. In the depicted embodiment, the top 6 of the lid 3 has a flat groove extending between opposite side walls 7*a*, 7*b* that increases the stability of the lid and also produces an attractive visual appearance.

A coupling device 8*a*, 8*b* is also fashioned to pivot on the two opposite side walls 7*a*, 7*b* of the bottom part 2, only the coupling device 8*a* of which is shown in FIG. 1. The coupling devices 8*a* and 8*b* are arranged in FIG. 1 in a pivoted-in rest position, in which the coupling devices 8*a*, 8*b* are fully beneath the top 6 of the lid 3. As an alternative, however, it is also possible to fasten the coupling devices 8*a*, 8*b* to pivot on two opposite side walls of the lid 3, in which case the features described below are otherwise designed identically.

Figure 2:
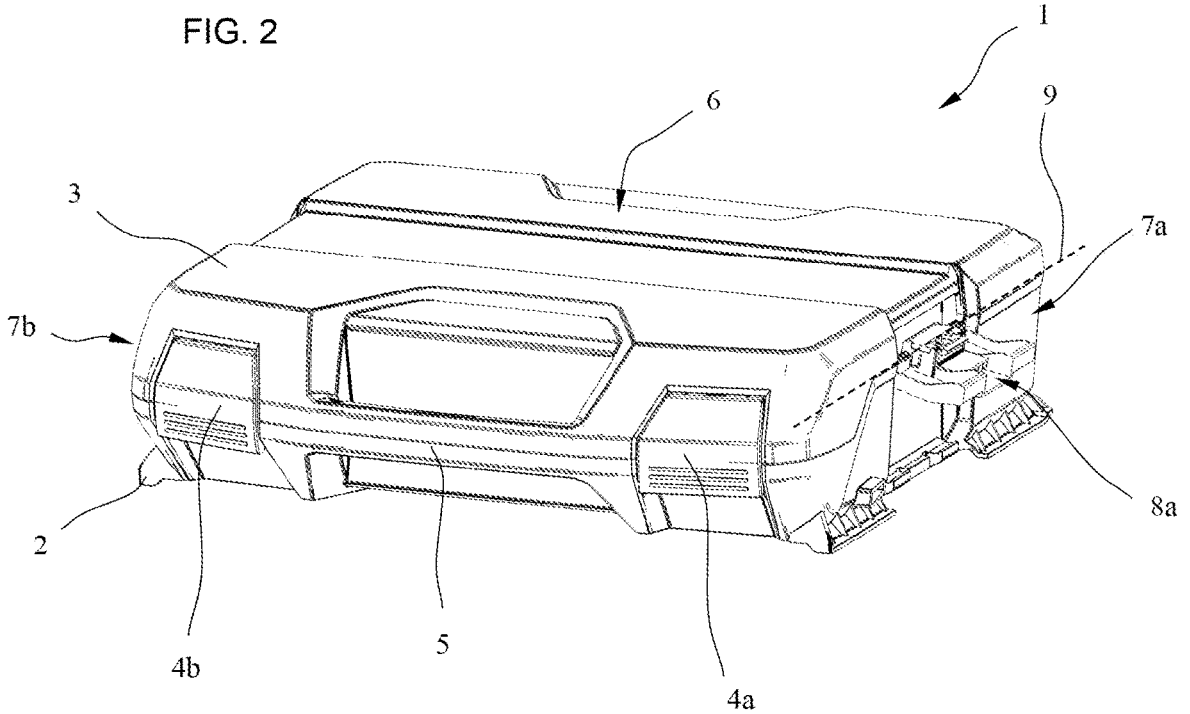
FIG. 2 shows a perspective view of the stackable system container of FIG. 1 with partially pivoted-out coupling devices.

Another perspective view of the stackable system container of FIG. 1 is shown in FIG. 2, in which, in contrast to FIG. 1, the coupling devices 8*a*, 8*b* are pivoted out from the rest position in the direction of a coupling position. The depicted pivot position then represents merely an intermediate step. However, as can be clearly seen, the coupling device 8*a* can be pivoted around a horizontal pivot axis 9 parallel to the side wall 7*a*. Likewise, the other coupling device 8*b* (not shown) can also be pivoted around another parallel, horizontal pivot axis corresponding to the opposite side wall 7*b*.

Figure 3:
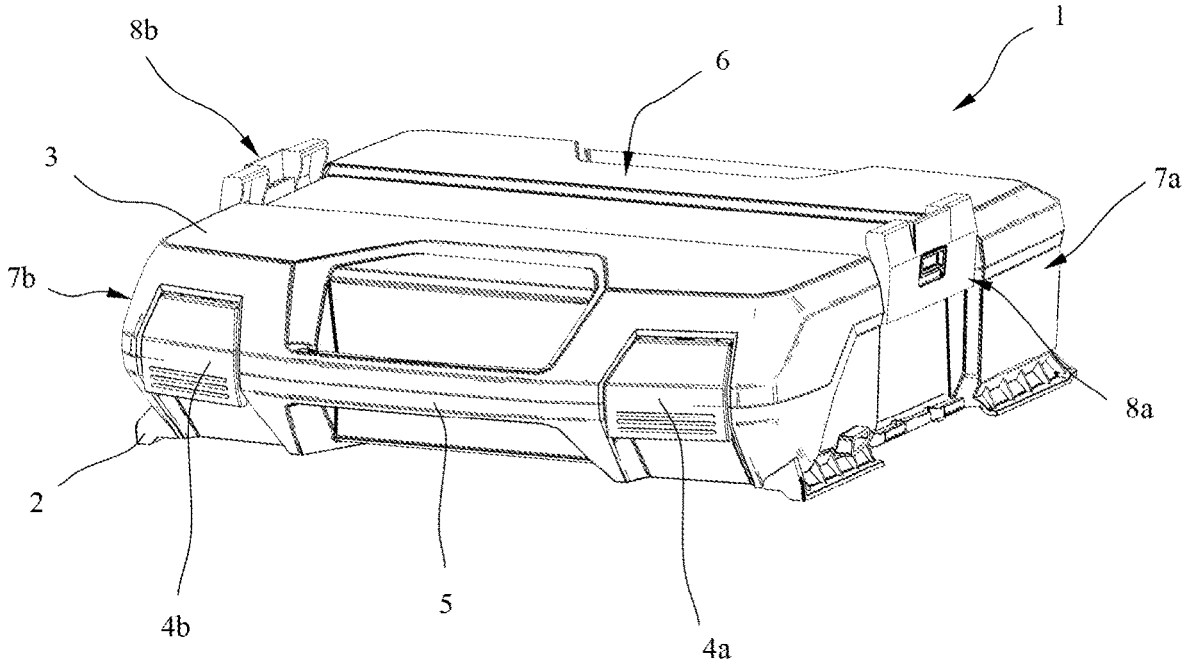
FIG. 3 shows a perspective view of the stackable system container of FIG. 1 with the coupling devices in the pivoted-out coupling position.

Finally, a perspective view of the stackable system container 1 of FIG. 1 is shown in FIG. 3 with the coupling devices 8*a*, 8*b* in the pivoted-out coupling position, in which the coupling devices 8*a*, 8*b* protrude beyond the top 6 of the lid 3. The relevant top 6 of the lid 3 is then formed by the essentially upper horizontal section of the lid 3. Through the described overhang of coupling devices 8*a*, 8*b* beyond the top 6 of the lid 3 an additional system container 1' arranged on the top 6 can be held stably and fixed relative to the lower system container 1, as is explained with reference to the following figures.

Figure 4:
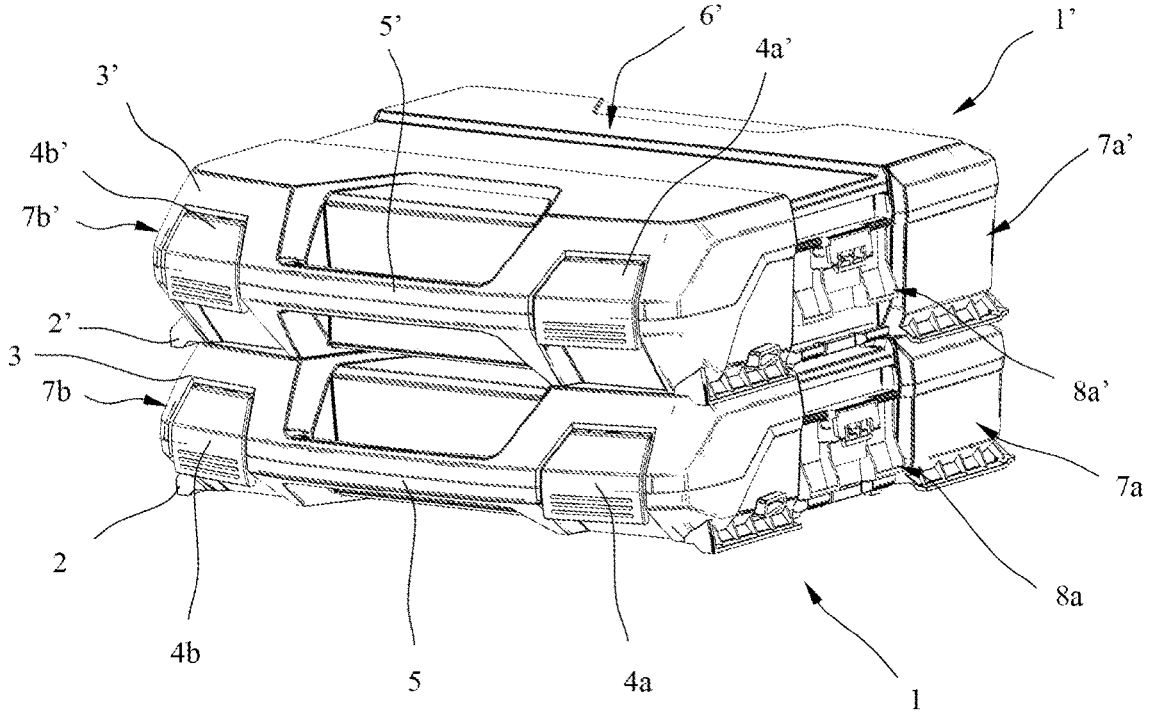
FIG. 4 shows a perspective view of the two system containers stacked one atop the other of FIG. 1 in which the coupling devices are arranged in the pivoted-in rest position.

A perspective view of two system containers 1, 1' stacked one atop the other is shown in FIG. 4, the system containers being designed essentially identical. Identical or equivalent system containers 1' are understood to mean system containers that are designed to cooperate retentively with the two coupling devices 8*a*, 8*b* of the system container 1, different embodiments also being included with reference to dimensions or the presence of additional elements. In this sense the depicted additional system container 1' does have an enlarged bottom part 2' and therefore a larger storage space, but the other elements are designed identically to the lower system container 1 and are therefore marked using the same reference number, with the simple addition of an apostrophe.

The coupling devices 8*a*, 8*b* of the lower system container 1 in the depicted arrangement are arranged in the pivoted-in rest so that the stacked system containers 1, 1' are not connected to each other in shape-mated fashion and can be simply separated. This is advantageous, for example, in logistics during transport of the system containers 1, 1', in which the system containers 1, 1' can be quickly and simply separated. In addition, a differently configured system container could be provided instead of an identical system container 1', because the top 6 forms an essentially flat storage space through the pivoted-in coupling devices 8*a*, 8*b* of the lower system container 1.

Figure 5:
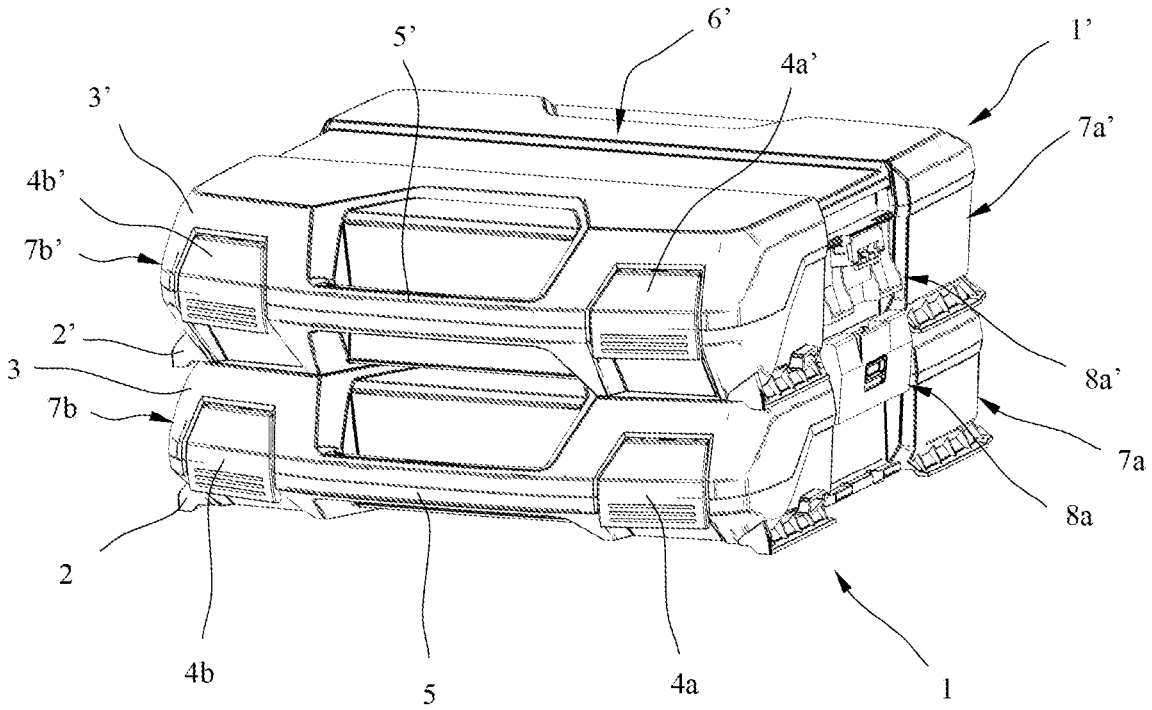
FIG. 5 shows a perspective view of the two system containers of FIG. 4 stacked one atop the other, in which the coupling devices of the lower system container are arranged in the pivoted-out coupling position.

A perspective view of the two system containers 1, 1' stacked one atop the other from FIG. 4 is shown in FIG. 5, in which the coupling devices 8*a*, 8*b* of the lower system container 1 are arranged in the pivoted-out coupling position. The upper system container 1' is connected on this account in shape-mated fashion to the lower system container 1 using the coupling device 8*a*, 8*b*, which permits stable stacking, specifically of system containers that are heavy. The structure and function of the coupling 8*a*, 8*b* are described in detail by means of the following figures.

Figure 6:
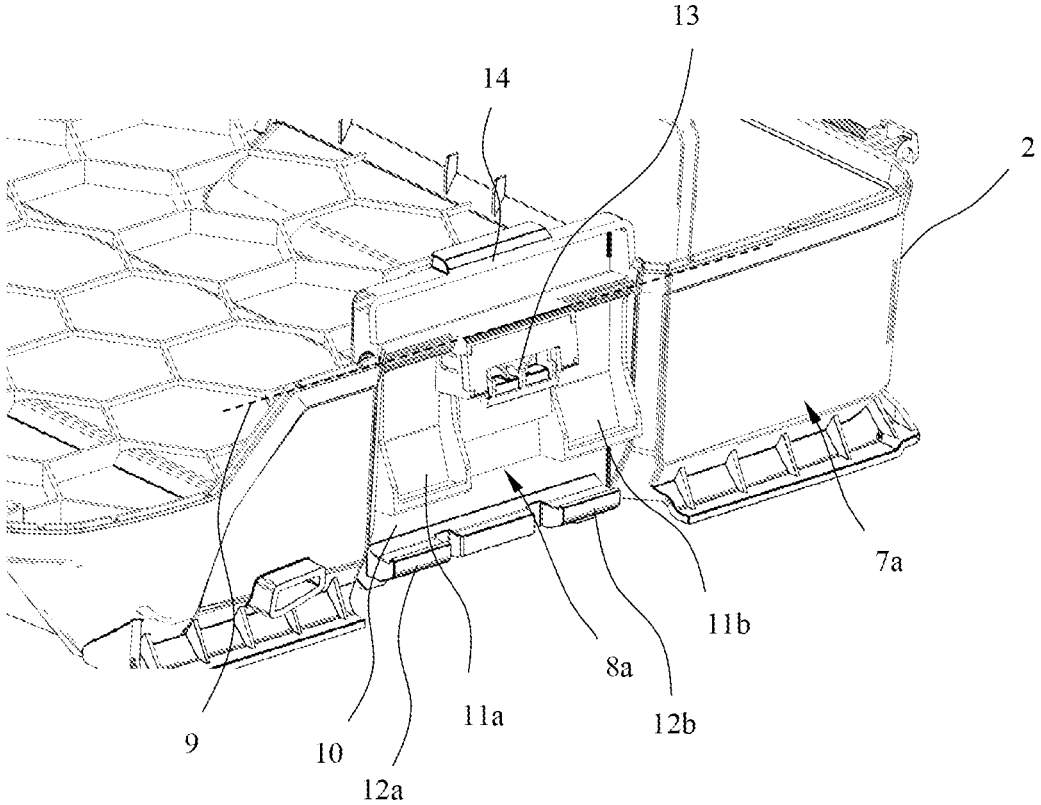
FIG. 6 shows a perspective detail view of the coupling device in the pivoted-in rest position.

A perspective detail view of a coupling device 8*a* is shown in FIG. 6 in a pivoted-in rest position. For improved illustration, the lid 3 is not depicted. As is apparent, the coupling device 8*a* is fastened to pivot around the schematically depicted pivot axis 9 on the side wall 7*a* of the bottom part 2 and is arranged in the depicted rest position in a recess 10 in the side wall 7*a*. The coupling device 8*a* has two coupling elements 11*a*, 11*b* that serve to position and fix an additional system container, for example, the system container 1' of FIGS. 4 and 5, in the pivoted-out coupling position of the coupling device 8*a*.

The coupling elements 11*a*, 11*b* are designed here as pockets or recesses, but they can also be designed as protrusions. Two counter-elements 12*a*, 12*b* are arranged fixed beneath the coupling device 8*a* and specifically beneath the coupling elements 11*a*, 11*b*, on the side wall 7*a* of the bottom part 2, which are designed for retentive cooperation with corresponding coupling elements of an additional system container arranged underneath. The counter-elements 12*a*, 12*b*, designed here corresponding to the coupling elements 11*a*, 11*b* as protrusions, are dimensioned so that they can be accommodated in shape-mated fashion in the coupling elements 11*a*, 11*b*, which are designed as pockets or recesses. In the event the coupling elements 11*a*, 11*b* are instead designed as protrusions, the counter-elements 12*a*, 12*b* are designed accordingly as pockets or recesses.

The counter-element 12*a* is also arranged in the plane of rotation of the coupling element 11*a* or on the pivot axis 9 and the counter-element 12*b* in the plane of rotation of the coupling element 11*b* around the pivot axis 9. This guarantees that, when two identical system containers 1, 1' are positioned exactly one atop the other, the coupling elements 11*a*, 11*b* of the lower system container 1 can engage retentively in shape-mated fashion in the coupling position of the coupling device 8*a* relative to the counter-elements 12*a'*, 12*b'* of the upper system container P.

So that the coupling device 8*a* can be locked in the pivoted-out coupling position, it includes a locking element 13 fastened movably to the coupling device 8*a*. A snap-in tab 14 is provided in the side wall 7*a*, specifically in the recess 10, which is designed to be undercut by the locking element 13, thus locking it in a locking position when the coupling device 8*a* is arranged in the coupling position.

Figure 7:
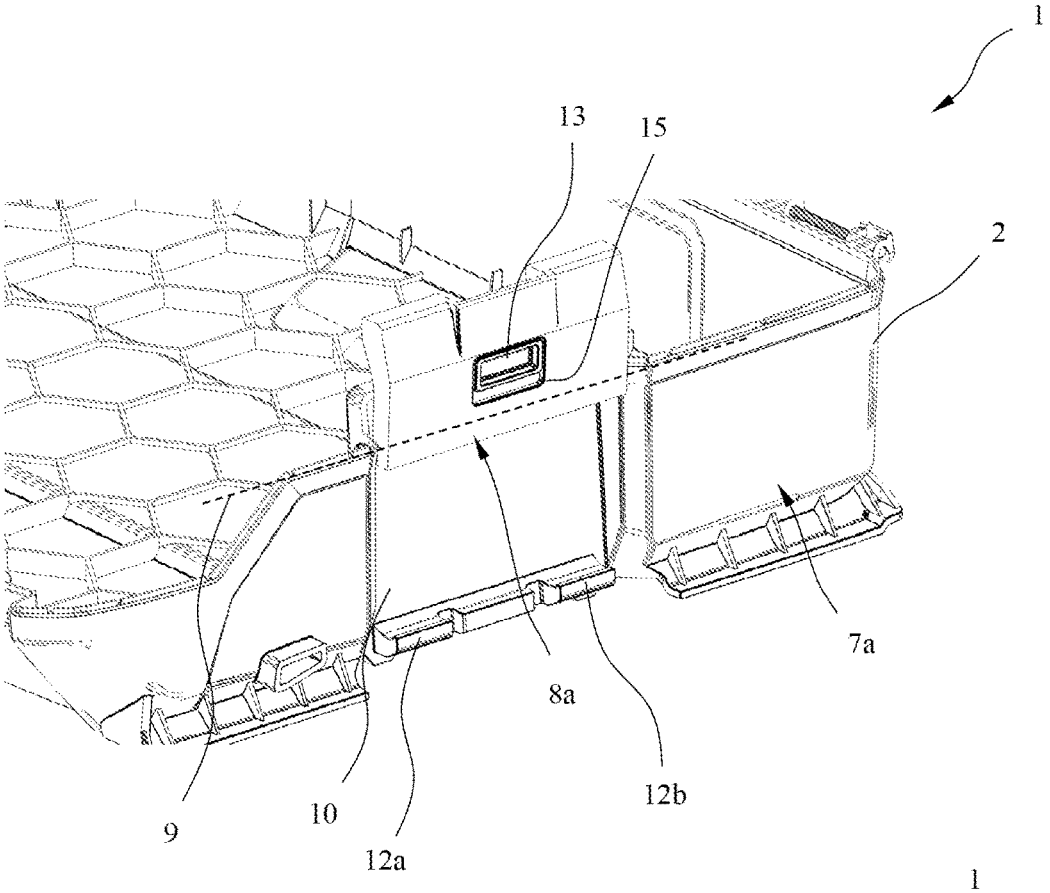
FIG. 7 shows another perspective detail view of a coupling device in the pivoted-out coupling position.

Another perspective detail view of the coupling device 8*a* is shown in FIG. 7 in the pivoted-out coupling position. As described, the locking element 13 here is arranged in the locking position and engages behind the snap-in tab 14 (not shown) in the recess 10 of the side wall 7*a* so that the coupling device 8*a* is held releasably in the pivoted-out coupling position. The locking element 13 in the depicted coupling position of the coupling device 8*a* can be manually grasped from the outside through a recess 15 in the coupling device 8*a* so that displacement of the locking element 13 from the locking position and therefore release of the coupling device 8*a* from the coupling position is made possible.

Figure 8:
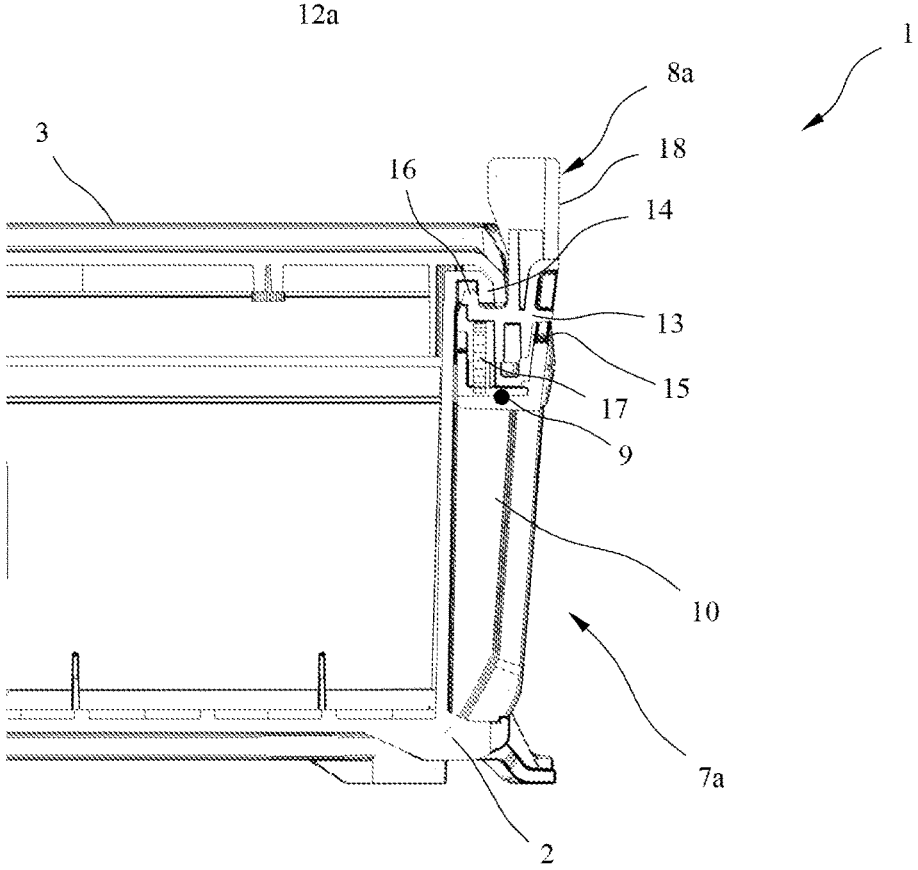
FIG. 8 shows a sectional view through a system container in the area of a coupling device in the pivoted-out coupling position.

A sectional view through the system container 1 is depicted in FIG. 8 in the area of the coupling device 8*a* and the pivoted-out coupling position. As can be seen, the snap-in tab 14 is retentively engaged in the recess 10 of the side wall 7*a* by the locking element 13, specifically by a hook-like element 16 arranged on the locking element 13, so that rotation of the coupling device 8*a* around the schematically indicated pivot axis 9 is prevented and the coupling device 8*a* is therefore locked in the depicted coupling position.

In order to hold the locking element 13 in the depicted locking position, a spring element 17 is provided that is supported on a contact surface of the coupling device 8*a* and forces the locking element 13 into the depicted locking position. Through the recess 15 in the coupling device 8*a*, the locking element 13 can be activated from the outside 18 of the coupling device 8*a* and moved against the action of the spring element 17 downward into a released position. The hook-like element 16 in this released position of the locking element 13 (not shown) is disengaged from the snap-in tab 14 so that the coupling device 8*a* can be rotated around the pivot axis 9 into the pivoted-in rest position.

As follows from the figures, the coupling device 8*a* can be pivoted between the pivoted-out coupling position and the pivoted-in rest position by essentially 180°, specifically by 160-200°. The pivot axis 9 is then made parallel to the side wall 7*a* and arranged on the coupling device 8*a* and the side wall 7*a* so that the locking element 13 in the pivoted-in rest position of the coupling device 8*a* is arranged beneath the pivot axis 9 and above the pivot axis 9 in the pivoted-out coupling position.

In the depicted embodiment, the coupling device 8*a* in the coupling position also not only protrudes above the top 6 of the lid 3, but also protrudes in the direction of the lid 3 so that the lid 3 is partially engaged by the coupling device 8*a*. The lid 3 is held on this account by the coupling device 8*a* and also the opposite additional coupling device 8*b* in the closed position. The coupling device 8*b* (not shown) on the opposite side wall 7*b* of the bottom part 2 is designed as a mirror image of the bottom part 2 so that in this respect the description concerning the coupling device 8*a* and the side wall 7*a* is referred to.

Figure 9:
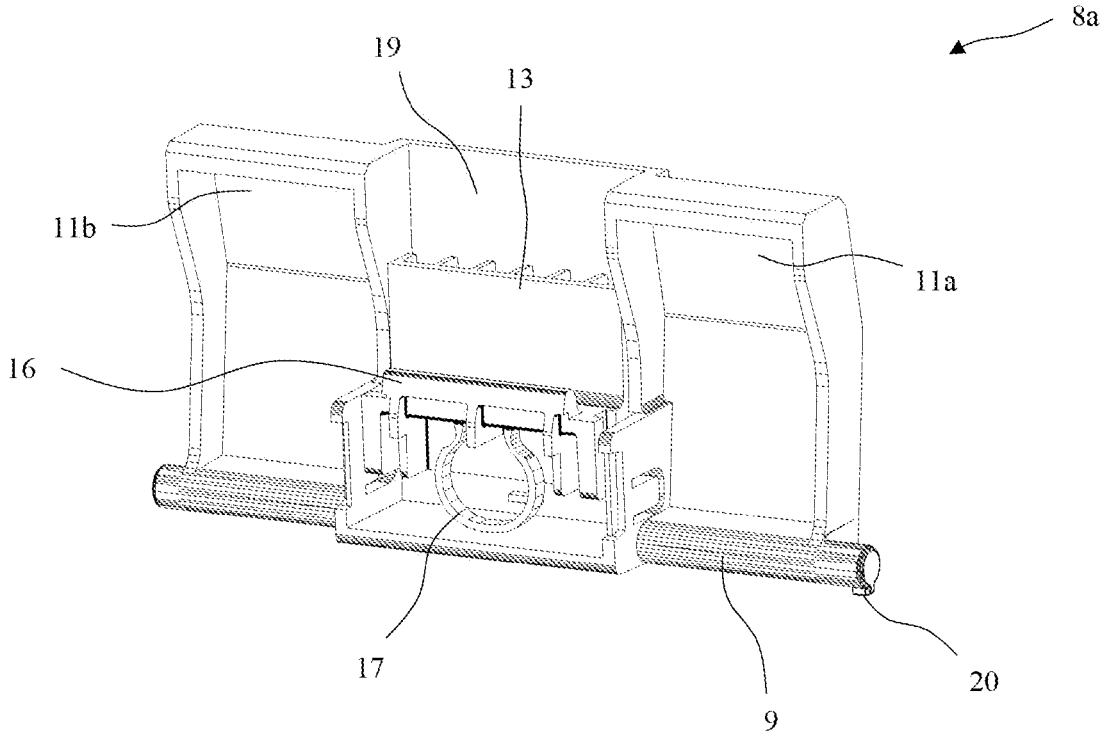
FIG. 9 shows a perspective rear view of a released coupling device.

A perspective rear view of a released coupling device 8*a* is shown in FIG. 9. As is apparent, the spring element 17 is shown as annular and fastened to the locking element 13. Opposite the locking element 13, the spring element 17 is supported on a contact surface of the coupling device 8*a* and biased so that the locking element 13 is forced into the depicted upper locking position. The locking element 13 is arranged movable longitudinally in the guide groove 19 of the coupling device 8*a*, in which case the guide groove 19 extends in the radial direction from the pivot axis 9. The upper open end of the guide groove 19 is arranged between the coupling elements 11*a*, 11*b* and also forms in the extended coupling position a receptacle and centering for an additional system container 1' arranged atop it.

As can be further seen from FIG. 9, the hook-like element 16 on the side facing the bottom part 2 in the pivoted-out coupling position has a bevel or rounding in order to achieve automatic locking of the locking element 13 when the coupling device 8*a* is forced against the bottom part 2 in the pivoted-out coupling position. The locking element 13 is pushed by the bevel or rounding briefly from the locking position by the oblique support between the snap-in tab 14 and the hook-like element 16, whereupon the spring element 17 forces the hook-like element 16 back into the locking position in which the snap-in tab 14 is engaged by the hook-like element 16.

The pivot axis 9 also has a locking protrusion 20 on at least one end that protrudes in the radial direction from the pivot axis 9. A snap-in device for the coupling device 8*a* in the pivoted-in rest position can be formed by means of this locking protrusion 20, as shown by means of the following figures.

Figure 10:
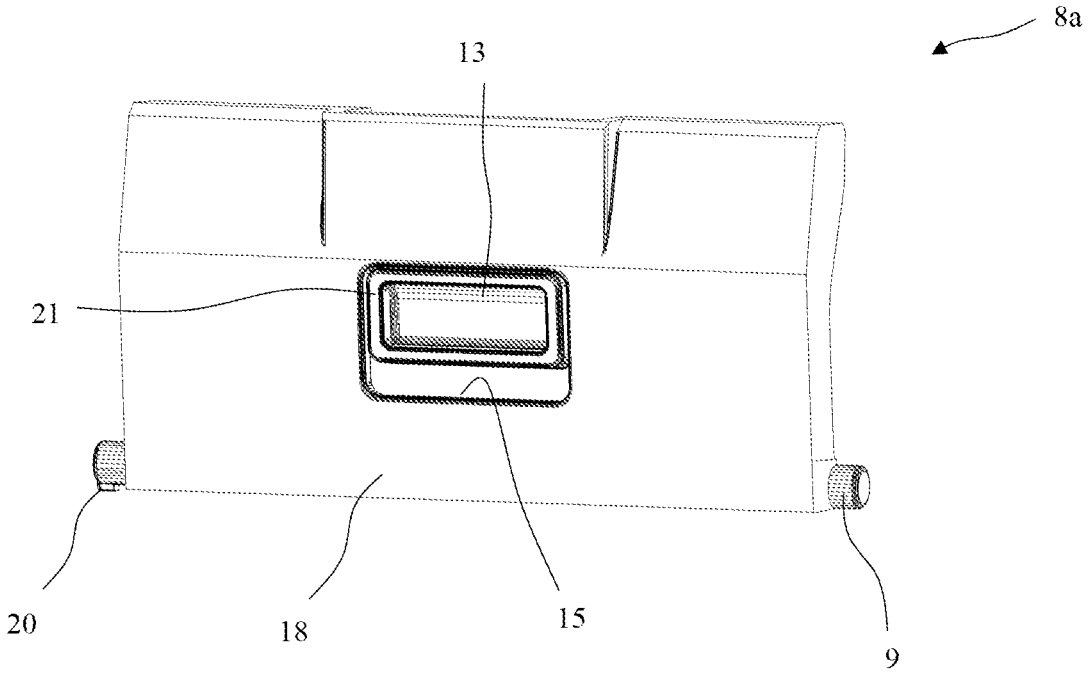
FIG. 10 shows a perspective front view of the released coupling device of FIG. 9.

A perspective front view of the released coupling device 8*a* of FIG. 9 is shown in FIG. 10. As can be seen, the locking element 13 protrudes with a handle 21, which is formed by a peripheral closed space, into the recess 15 in the coupling device 8*a* in the direction of the outside 18 so that the locking element 13 is simply engaged by the handle 21 and can be moved in the depicted representation downward from the locking position into the released position. The spring element 17 depicted in FIG. 9 is biased on this account, which then forces the locking element 13 back into the locking position.

Figure 11:
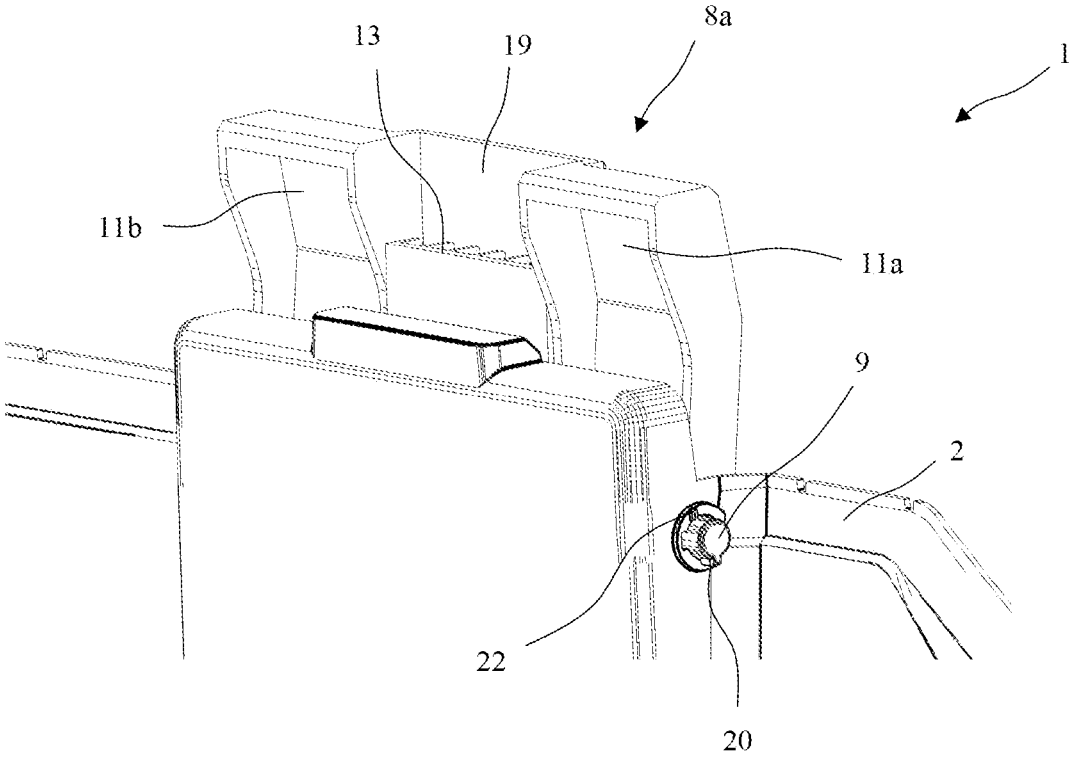
FIG. 11 shows a perspective rear view of the coupling device on a system container in the pivoted-out coupling position.

A perspective rear view of the coupling device 8*a* on the system container 1 is shown in FIG. 11 in the pivoted-out coupling position. For simple depiction, the lid 3, however, is not shown here. As can be seen, the bottom part 2 has a locking ridge 22 on a support site for the pivot axis 9, which is arranged fixed on the side wall 7*a* slightly spaced radially from the pivot axis and overlaps at least partially with the locking protrusion 20 in the peripheral direction of the pivot axis 9. This guarantees that, during rotation of the coupling device 8*a*, the locking protrusion 20 comes in contact with the locking ridge 22, and a defined force is necessary in order to move the locking protrusion 20 past the locking ridge 22. The locking protrusion 20 and the locking ridge 22 are then arranged relative to each other so that the coupling device 8*a* is in the rest position when the locking protrusion 20 has been moved beyond the locking ridge. The coupling device is locked releasably and in the correct position by the support on the recess 10, on one side, and the support on the locking ridge 22 via the locking protrusion 20, on the other side, in the rest position. In the depicted pivoted-out coupling position, the locking protrusion 20 lies against the pivot axis 9 and the locking ridge 22 against the bottom part 2 so that no mutual contact or locking effect occurs.

Figure 12:
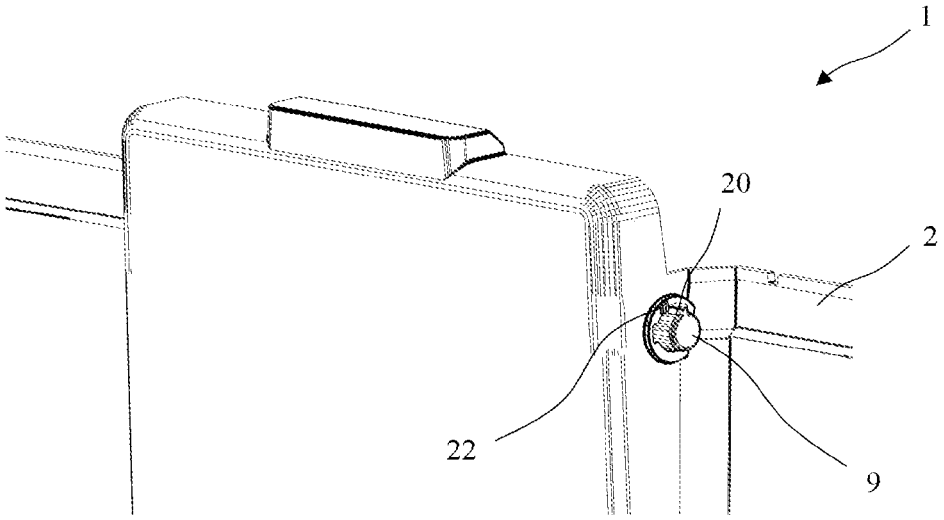
FIG. 12 shows a perspective rear view of the coupling device on a system container in the pivoted-in rest position.

A perspective rear view of the coupling device 8*a* on the system container 1 is shown in FIG. 12 in the pivoted-in rest position. The coupling device 8*a* is rotated here relative to the coupling position of FIG. 11 clockwise around the pivot axis 9, in which case the locking ridge 22 is arranged so that the locking protrusion 20 on the pivot axis 9 comes in contact with the locking ridge 22 just in front of the pivoted-in rest position of the coupling device 8*a*. With limited force expenditure the locking ridge 22 can then be overcome with the locking protrusion 20 so that the locking protrusion 20 locks the pivot axis 9 and therefore the coupling device 8*a* in the pivoted-in rest position releasably, as described. Using the locking protrusion 20 and the locking ridge 22, a simple snap-in device for locking of the coupling device 8*a* in the rest position is thereby formed. By exerting a sufficient torque on the coupling device 8*a*, this snap-in device can also be simply overcome during locking and also release.

LIST OF REFERENCE NUMBERS

1, 1' Stackable system containers
2, 2' Bottom part
3, 3' Lid
4*a*, 4*b*, 4*a'*, 4*b'* Closure device
5, 5' Handle
6, 6' Top of lid
7*a*, 7*b*, 7*a'*, 7*b'* Side wall
8*a*, 8*b*, 8*a'* Coupling device
9 Pivot axis
10 Recess
11*a*, 11*b* Coupling element
12*a*, 12*b* Counter-element
13 Locking element
14 Snap-in tab
15 Recess
16 Hook-like element
17 Spring element
18 Outside of coupling device
19 Guide groove
20 Locking protrusion
21 Handle
22 Locking ridge

The invention claimed is:

1. A stackable system container comprising:
a bottom part;
a lid fastened to the bottom part; and
a first coupling device fastened movably to one side wall of the bottom part or lid, and a second coupling device fastened movably to an opposite side wall of the bottom part or lid,
wherein each of the coupling devices is movable between a rest position, in which each of the coupling devices is arranged beneath the top of the lid, and a coupling position, in which each of the coupling devices protrudes beyond the top of the lid,
wherein a locking element is movably fastened to at least one of the coupling devices for fixation of the at least one of the coupling devices, the locking element releasably locking the at least one of the coupling devices in the coupling position so as to prevent movement into the rest position, and
wherein the locking element includes a hook-like element for releasably locking the at least one of the coupling devices in the coupling position.

2. The stackable system container according to claim 1, wherein each of the coupling devices has at least one coupling element for positioning and fixing an additional system container on the top of the lid.

3. The stackable system container according to claim 2, wherein, beneath each of the coupling devices, a counter element corresponding to the at least one coupling element is provided on the side wall for retentive cooperation with a corresponding coupling element of a coupling device of an additional system container arranged underneath.

4. The stackable system container according to claim 1, wherein each of the coupling devices is pivotably fastened to one of the side walls so as to be pivotable between the pivoted-in rest position and the pivoted-out coupling position.

5. The stackable system container according to claim 4, wherein each of the coupling devices can be pivoted around a pivot axis parallel to one of the side walls, and the pivot axis is arranged so that the locking element in the pivoted-in rest position is arranged beneath the pivot axis and in the pivoted-out coupling position above the pivot axis.

6. The stackable system container according to claim 1, wherein a spring element is arranged on each of the coupling devices that forces the locking element into a locking position that locks at least one of the coupling devices in the coupling position.

7. The stackable system container according to claim 1, wherein a snap-in tab is provided on each of the side walls that is engaged in a locking fashion by the corresponding locking element for locking at least one of the coupling devices in the coupling position.

8. The stackable system container according to claim 1, wherein each coupling device can be pivoted by 180° between the rest position and the coupling position.

9. The stackable system container according to claim 1, wherein the side walls each have a recess in which one of the coupling devices is movable into the rest position.

10. The stackable system container according to claim 1, wherein at least one snap-in device for locking of at least one of the coupling devices in the rest position is provided on each of the coupling devices.

11. The stackable system container according to claim 10, wherein the snap-in device can be overcome by exerting a sufficient torque on the at least one of the coupling devices.

12. The stackable system container according to claim 10, wherein the snap-in device can be overcome by activating a release lever.

13. The stackable system container according to claim 1, wherein the coupling devices lock the lid against opening in the coupling position.

14. The stackable system container according to claim 1, wherein the locking element releasably locks at least one of the coupling devices in the coupling position so as to prevent movement in any direction.

15. The stackable system container according to claim 1, wherein in the coupling position, the hook-like element engages a snap-in tab that is provided on the side wall, so that at least one of the coupling devices is releasably locked in the coupling position.

16. The stackable system container according to claim 1, wherein in the coupling position, the hook-like element must be disengaged from a snap-in tab, which is provided on the side wall, in order to move at least one of the coupling devices into the rest position.

17. The stackable system container according to claim 1, wherein each of the coupling devices can be pivoted around a pivot axis parallel to one of the side walls, the locking element releasably locking at least one of the coupling devices in the coupling position such that rotation of the at least one of the coupling devices around the pivot axis is prevented.

18. The stackable system container according to claim 17, wherein in the coupling position, the locking element must be released in order to rotate at least one of the coupling devices around the pivot axis into the rest position.

* * * * *